US005826232A

United States Patent [19]

Gulli

[11] Patent Number: 5,826,232

[45] Date of Patent: Oct. 20, 1998

[54] METHOD FOR VOICE ANALYSIS AND SYNTHESIS USING WAVELETS

[75] Inventor: Christian Gulli, St Medard en Jalles, France

[73] Assignee: Sextant Avionique, Meudon la Foret, France

[21] Appl. No.: 972,486

[22] PCT Filed: Jun. 16, 1992

[86] PCT No.: PCT/FR92/00538

§ 371 Date: Feb. 18, 1993

§ 102(e) Date: Feb. 18, 1993

[87] PCT Pub. No.: WO92/22890

PCT Pub. Date: Dec. 23, 1992

[30] Foreign Application Priority Data

Jun. 18, 1991 [FR] France ..... 91 07424

[51] Int. Cl.[6] ..... G10L 9/00

[52] U.S. Cl. ..... 704/267; 704/258; 704/265

[58] Field of Search ..... 395/2.76, 2.74

[56] References Cited

U.S. PATENT DOCUMENTS

| | | | |
|---|---|---|---|
| 4,384,169 | 5/1983 | Mozer et al. | 179/1 SM |
| 4,398,059 | 8/1983 | Lin et al. | 179/1 SM |
| 4,520,499 | 5/1985 | Montlick et al. | 381/36 |
| 4,599,567 | 7/1986 | Goupillaud et al. | 324/77 |
| 4,817,161 | 3/1989 | Kaneko | 381/51 |
| 4,974,187 | 11/1990 | Lawton | 364/728.9 |
| 5,086,475 | 2/1992 | Kutaragi et al. | 381/36 |

FOREIGN PATENT DOCUMENTS 2648567 12/1990 France .

OTHER PUBLICATIONS

Daubechies, I., *Orthonormal Bases of Compactly Supported Wavelets,* 1988, pp. 909–996.

Kronland–Martinet, R., *The Wavelet Transform for Analysis, Synthesis and Processing,* 1988, pp. 11–20.

Computer Music Journal, vol. 12, No. 4, Jan. 1, 1988, Cambridge, Massachusetts; R. Kronland–Martinet: "The Wavelet Transform For Analysis, Synthesis, And Processing Of Speech And Music Sounds", pp. 11–20.

Communications On Pure and Applied Mathematics, vol. XLI, 1988, I. Daubechies: "Orthonormal Bases Of Compactly Supported Wavelets", pp. 909–996.

International Journal on Pattern Recognition and Artificial Intelligence, vol. 1, No. 2, 1987, R. Kronland–Martinet et al: "Analysis Of Sound Patterns Through Wavelet Tranforms", pp. 273–302.

Traitement du Signal, vol. 7, No. 2, 1990, P. Mathieu: "Compression d'Image Par Transformee En Ondelette Et Quantification Vectorielle", pp. 101–115.

International Conference on Acoustics Speech and Signal Processing, vol. 3, Apr. 3, 1990, Albuquerque, New Mexico, USA, M. Vetterli et al: "Wavelets And Filter Banks: Relationships And New Results", pp. 1723–1726.

International Conference on Acoustics Speech and Signal Processing, vol. 2, Apr. 6, 1987, Dallas, Texas, USA, J.S. Lienard: "Speech Analysis And Reconstruction Using Short–Time, Elementary Waveforms", pp. 948–951.

*Primary Examiner*—Allen R. MacDonald
*Assistant Examiner*—Vijay B. Chawan
*Attorney, Agent, or Firm*—Oblon, Spivak, McClelland, Maier & Neustadt, P.C.

[57] ABSTRACT

The voice synthesis of the invention analyzes a voice signal by orthogonal breakdown on a basis of wavelets with compact support, preferably Daubechies wavelets. The synthesis is carried out on the basis of coefficients which are stored and selected during the analysis, according to the same algorithm as that used for the analysis.

9 Claims, 4 Drawing Sheets

METHOD FOR VOICE ANALYSIS AND SYNTHESIS USING WAVELETS

BACKGROUND OF THE INVENTION

1. Field of the Invention

The present invention relates to a method for voice synthesis.

2. Discussion of the Background

Among the numerous fields of application of voice synthesis, some, such as interactive control appliances (control of vehicles, of industrial processes, etc.) require only to synthesize simple messages (isolated words or predetermined phrases). In such applications, it is sought to minimise the cost of the voice synthesis device. The reduction in cost may be brought about essentially by using mass production circuits and by reducing the memory capacity necessary for storing the messages.

In order to reduce this memory capacity, the prior art calls on various types of coding. Among the most widely used codings, time coding is known, which associates a binary code at discrete instants with the amplitude of the signal, and, more precisely, the difference between the signal and its predictable component (differential coding) instead is stored in memory. Recourse is also had to coding the speech by analysis and synthesis, according to which only a very few significant parameters are stored (devices known as: "channel vocoder" or "linear prediction vocoder"). Finally, a method is known which results from the combination of the two above-mentioned methods: "adaptive predictive vocoder" or "voice excitation vocoder", in particular coding in sub-bands.

In the case of sub-band coding, which is coding in the frequency domain, the spectrum of the signal to be coded is broken up into a certain number of sub-bands of width $B_k$ (equal to each other or otherwise). Each sub-band (of index k) is next resampled at the Shannon frequency, i.e. $2B_k$. The signals leaving each sub-band filter are quantified differently on the basis of frequency, namely fine quantization for the fundamental and the formants, and coarse quantization in the regions where the energy is low. The reverse operation is carried out to reconstruct the signal.

Before storage and transmission, the signals are coded, for example, according to a PCM (pulse code modulation) coding law, normalized to 64 kbits/s (signal sampled at 8 kHz over 8 bits in the 300–3600 Hz band and compressed according to a logarithmic law). ADPCM coding (adaptive differential PCM), at a rate of 32 kbits/s (8 kHz over 4 bits), is becoming widespread.

In FIG. 1 is represented the theoretical diagram of a coding device 1 with two sub-bands. The speech signal x is filtered by two filters F1, F2 (with pulse responses h1, h2). Each of the two output sub-bands of F1, F2 is decimated by 2 (suppression of one sample in 2) by the circuits 2, 3 respectively, then coded (4), for example in ADPCM and stored (or transmitted). On reading (or reception), the reconstitution of the speech signal is done by decoding (5, 6) then filtering in interpolators (7, 8) which are identical to those of the corresponding analysis and summation band (9) for the two decoded sub-bands. The filters F1 and F2 are linear-phased FIR (finite impulse response) filters, and satisfy the following conditions.

$$h_2(n)=(-1)^n\, h1(n)$$

$$|H_1(e^{j\theta})|^2+|H_2(e^{j\theta})|^2=1$$

The template of these filters has been shown it FIG. 2.

The principle of sub-band coding consists in filtering the speech signal via a bank of filters, then in sub-sampling the output signals from these filters. On reception, reconstitution is done by addition of each decoded sub-band, interpolated by a filter identical to that of the corresponding analysis band. This type of coding was first introduced on the basis of separate and contiguous finite impulse response filters. It was then extended by virtue of the use of quadrature mirror filters, allowing near-perfect reconstitution of the initial signal in the absence of error in quantization.

Two large families of methods exist for synthesising the filters which break down the speech signal:

- either the input is split up into two bands by an optimized filter, and the algorithm is renewed for each band;
- or a band pass filter template is displaced on the frequency axis. In this case, the basic filter response is h(n) and the band width $\pi/2M$ (M being the number of sub-bands). By displacement is obtained:

$$h_i(n)=h(n)\cdot\cos(n\pi(2i+1)/2M)$$

$\pi$ being the normalized sampling half-frequency. The problem of aliasing of the filters during sub-sampling may be compensated for by a phase term in the phase shift cosine function.

The half-band filter, whose template is represented in FIG. 2, is conventionally a linear filter whose transfer function is equal to ½ at fe/4 (fe=sampling frequency) and is antisymmetric with respect to this point, that is to say that:

$$H_1[fe/4+f]=1-H[fe/4-f]$$

The coefficients h(n) are nil for even n, except h0. The template is defined by the ripple in passing band and cut-off band, and by $\Delta f$ which represents the width of the transition band. The number N of coefficients of the filter as a function of the desired template is given by the approximate relationship:

$$N=\frac{2}{3}\log\left(\frac{1}{10\delta^2}\right)\frac{fe}{\Delta f}$$

in which $\delta=\delta_1=\delta_2$ represents the passing and cut ripple in the bands. Lowering or raising the sampling frequency is brought about by putting P half-band filters in cascade. The intermediate frequency fi is a sub-multiple of the sampling frequency in a ratio:

$$fe=2^P\cdot fi.$$

Devices also exist carrying out multi-resolution analysis of the speech signal, and essentially comprising a discrete filter and a "decimation" circuit (suppression of one sample in two). A rapid algorithm for digital image compression is also known ("Traitement de Signal", vol. 7, no. 2, 1990), employing a transformation into wavelets, but this algorithm is suitable only for images (only the HF component is kept).

The known devices are either too rudimentary, and do not make it possible to obtain a sufficiently intelligible speech signal at restoration, or too complex and thus expensive.

SUMMARY OF THE INVENTION

The subject of the present invention is a method for voice synthesis which makes it possible to synthesize speech signals as simply as possible and relies, for its implementation, only on existing inexpensive circuits.

The method of the invention consists in digitizing a voice signal, in cutting up this digitized signal into an orthogonal basis of wavelets with compact support, in storing the coefficients representing the voice signal, and, on restoration, in reconstituting the voice signal by filtering, interpolation and low-frequency amplification.

BRIEF DESCRIPTION OF THE DRAWINGS

The invention will be better understood on reading the detailed description of an embodiment, taken by way of non-limiting example and illustrated by the attached drawing, in which.

DESCRIPTION OF THE PREFERRED EMBODIMENTS

Figure 1:
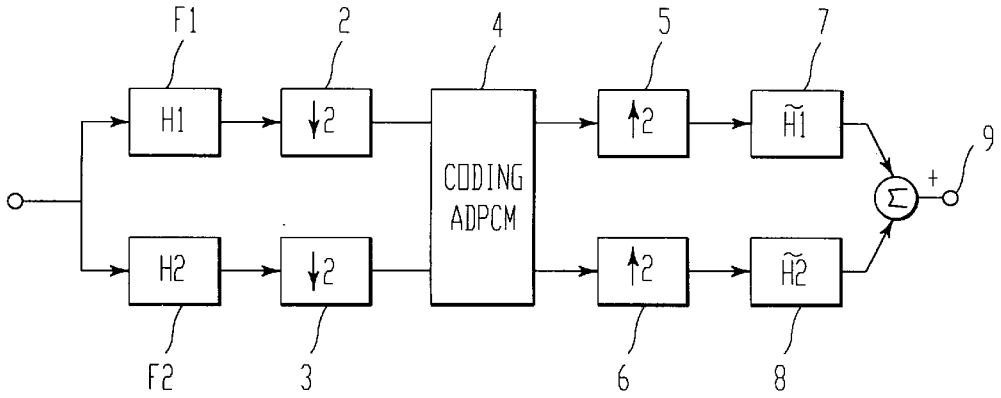
FIG. 1 PRIOR ART
FIG. 1, already described above, is a block diagram of a known coding system.
Figure 2:
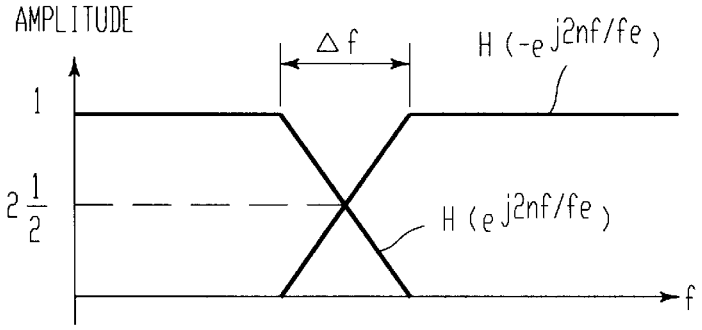
FIG. 2 is a half-band filter template usable in the system of FIG. 1.
Figure 3:
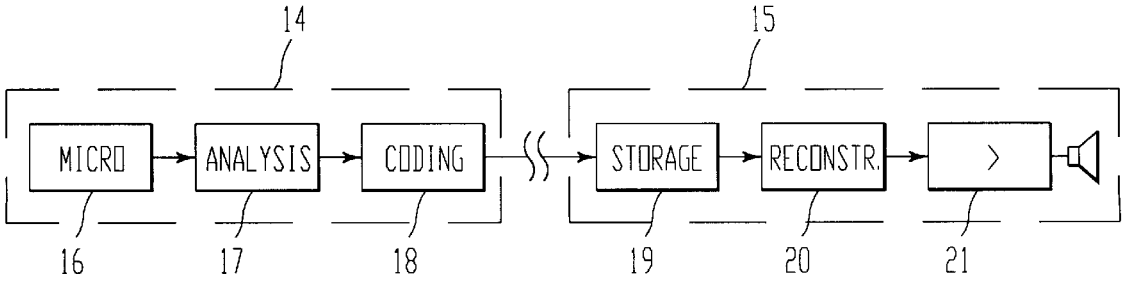
FIG. 3 is a block diagram of a synthesis system employing the method in accordance with the invention.

The voice messages synthesizer described below comprises two main parts: an analysis part 14 and a voice synthesis part 15 (FIG. 3).

In part 14, the signals-from the source 16 (for example a microphone) are quantized, then analysed at 17 and coded at 18. The relevant criteria which result therefrom are stored at 19 (for example EEPROM-type memories). All these operations are, in the present instance, carried out in the laboratory.

In the second part, which comprises the storage device 19, a device 20 carries out reconstitution of the signal from selected and stored (at 19) coefficients, and the reconstituted signal is sent to an amplifier 21 equipped with a loudspeaker.

Figure 8:
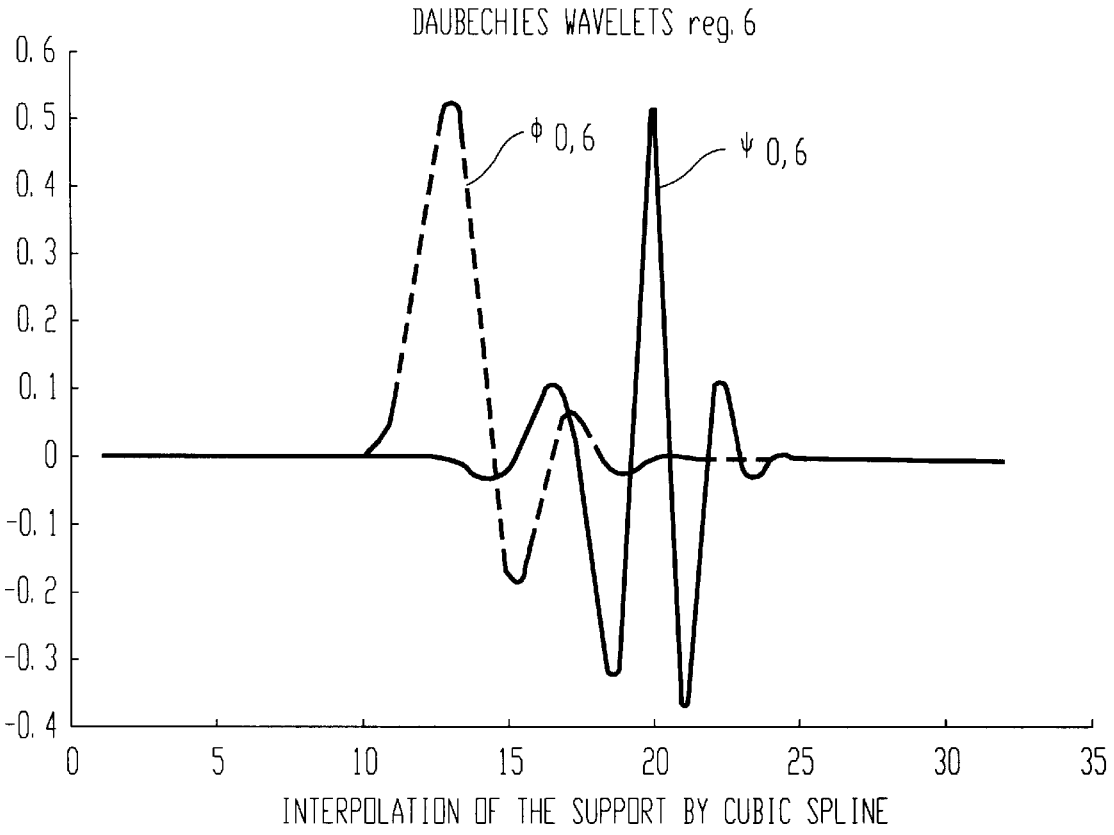
FIG. 8 is a timing diagram of a scale function and of a wavelet which are used by the invention.

According to the invention, for the coding and the reconstitution, an algorithm is employed which breaks down the voice signal into an orthogonal basis for wavelets with compact support. These wavelets are, for example, Daubechies wavelets (see FIG. 8). Only those coefficients judged to be representative of the starting voice signal and providing perfect intelligibility of the reconstituted message are stored, which greatly limits the throughput of signals to be stored.

Figure 4:
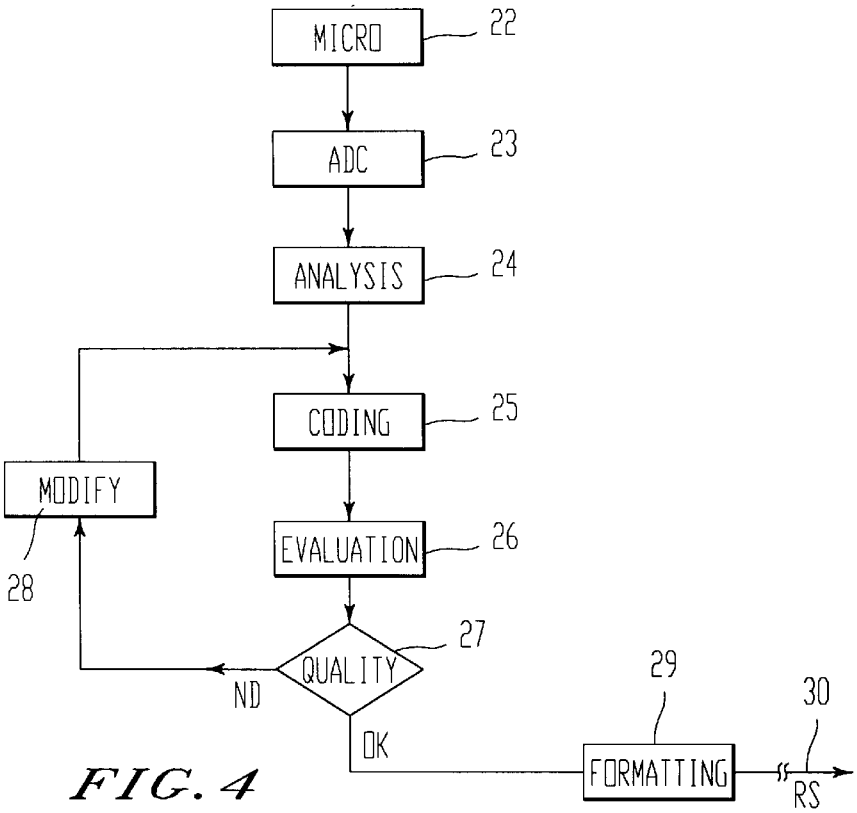
FIG. 4 is a block diagram of the analysis device of the system of FIG. 3.

The flow chart of FIG. 4 illustrates the voice analysis procedure in accordance with the invention.

The low-frequency signals produced by a source of low-frequency signals 22 (acoustic sensor, magnetic storage means, etc.) are digitized (23), for example over 16 bits, for example with the aid of a "flash" converter or of a successive-approximations converter (whose conversion time is of the order of 60 $\mu$s or less) at a sampling frequency, which is, for example, 10 kHz. The sampled signal is next cut up into frames of, for example, 128 points (duration of a frame: 12.8 ms). According to another example, it is possible to employ frames of 256 points, without significantly prejudicing the quality of the restoration. Next, analysis (24) is carried out, which constitutes an essential step of the invention. This analysis consists in particular in breaking down the digitized signal on an orthogonal basis of wavelets with compact support, and relies on filters whose pulse response may or may not be symmetric. In the event that this response is symmetric, the storage of the extreme coefficients (responsible for edge effects) is limited to a single side of the signal, the other side being deduced by symmetry (the periodicity of the filters is implicit by construction).

From the 128 initial points, therefore, by this breakdown 128 independent linear combinations of the observation basis are obtained. The regularity of the wave, which conditions the shape of the breakdown filter, is one of the two major parameters in the breakdown (with the level of breakdown, which conditions the width of the filter). Of these 128 combinations, 32, for example, are kept (estimated to be the most significant) which are coded (25), in the present case over 8 bits, which gives a throughput of values to be stored of 20 kbits/s. The selection of 16 coefficients coded over 16 bits would not change the throughput of values to be stored, but would reduce the quality of the restored signal.

It will be noted that the analysis by dilatation of the time scale (see scale function, in broken lines, in FIG. 8) is carried out not by dilating the analysis wavelets, but by subsampling the signal to be analyzed by a factor $2^P$. This results, for a breakdown to a level p, in (p+1) sets of coefficients. Moreover, the projection onto an orthogonal basis (with a number of points=N/2+N/4+. . . +N/$2^{P+1}$) induces neither loss nor redundancy of information. The representation in wavelets becomes (Sj, Dj)$0 \leqq j \leqq J$ where Sj is the approximation of the signal at the resolution $2^j$ and the Dj's correspond to the details with resolution $2^j$.

The parameters having been coded (25), an evaluation (26) is carried out, still in the laboratory, before storing them, by carrying out the synthesis, as described below. If (at 27) the quality of the restitution of the voice signal is poor, the choice of the parameters resulting from the analysis (24) is modified (28), and they are coded (26) for a new evaluation (25). If this quality is adjudged good, the frames of parameters (29) are shaped and they are transmitted, for example via a serial RS422 link (30), to the storage means.

Figure 5:
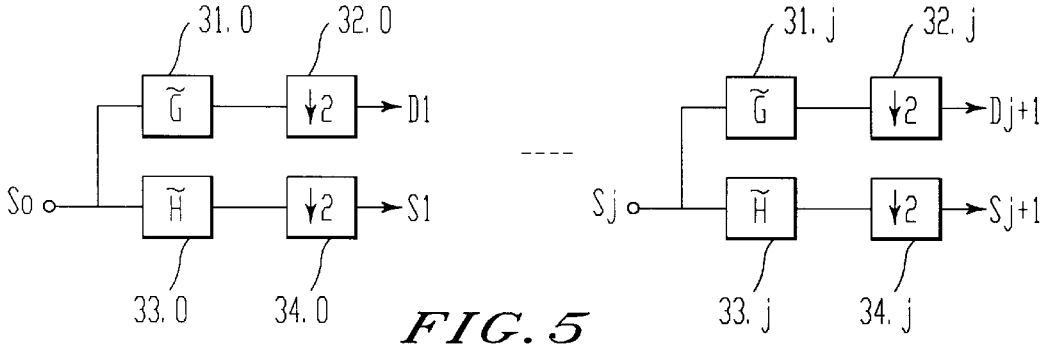
FIG. 5 is a diagram illustrating the breakdown algorithm of the invention.

At FIG. 5 the implementation of the breakdown algorithm according to the invention has been illustrated.

The various components S0 to Sj are each processed in the same way: convolution with the (j+1) filters $\tilde{G}$ (31.0 to 31.j) and their (j+1) respective mirrors $\tilde{H}$ (32.0 to 32.j) and decimation by 2 (respectively 32.0 to 32.j and 34.0 to 34.j).

For a regularity n, the support of the filter comprises 2n values. From the N starting coefficients, for N=1 there are 2 times N/2 coefficients, for N=2, 4 times N/4 coefficients, etc., but only N/2n are stored. Taking n=6, for example, a convolution over 12 points is implemented. This value implies that the convolution is carried out in the time domain. However, for a regularity greater than about 16, it is preferable, from the point of view of calculating time of the analysis processor, to substitute multiplication in the dual frequency space for convolution (which amounts to sectioned convolution).

The coding of the parameters (at 25) may be carried out either from local histograms, or, more simply, by quantization linked to an energy level fixed in advance.

The evaluation phase (26) consists in listening to the reconstituted message, and, as the case may be, if the hearing is not adjudged satisfactory, in modifying (28) the parameters to be stored. This reconstitution is done, as described in detail below, by digital/analog conversion, low-pass filtering for smoothing and low-frequency amplification. When the quality of the reconstituted message is adjudged satisfactory, the coefficients (29) are shaped and they are loaded (30) into an appropriate memory. The shaping consists essentially in formatting the data, producing the corresponding addresses and sequencing the successive frames of data.

Figure 6:
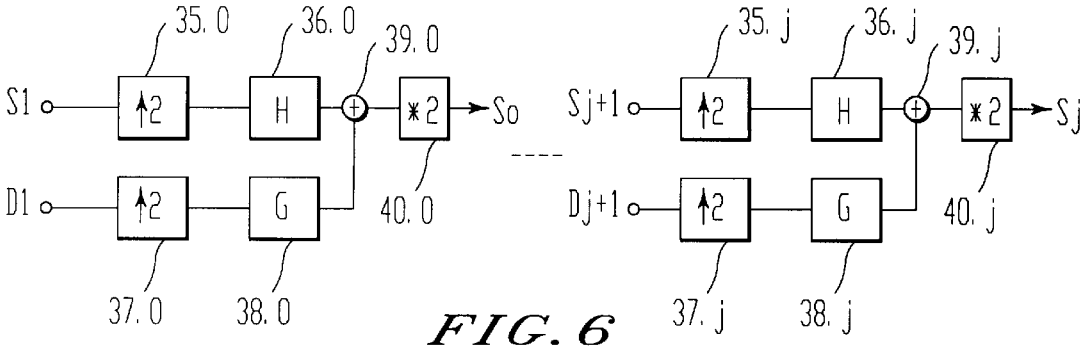
FIG. 6 is a diagram illustrating the reconstruction algorithm of the invention.

At FIG. 6 the voice synthesis algorithm proper implementing the method of the invention has been illustrated, constituting a self-contained means for generating messages, distinct from the laboratory synthesis device, mentioned above, that was used for evaluation of the choice of the parameters. This voice synthesis algorithm reconstitutes the original signal by proceeding by interpolation (35.0 to 35.j for S0 to Sj and 37.0 to 37.j for D0 to Dj), filtering (36.0 to 36.j and 38.0 to 38.j respectively), addition (39.0 to 39.j), multiplication (40.0 to 40.j) and low-frequency amplification. In effect, from the decomposition into wavelet-scale at level p (typically p=2 to 3), it is possible to reconstruct the breakdown at the level (p−1). To do that it is sufficient to insert nil values between each value of the decomposition at level p, then to convolute with the inverse ladder and wavelet functions according to the reconstruction algorithm detailed above.

The Daubechies wavelets, that the invention preferably uses, are wavelets with compact support, which, owing to this fact, minimize the number of points of their pulse response, thus of the convolution.

The filters for breakdown are identical to those for reconstruction, but they are not symmetric, which necessitates storing the coefficients due to the edge effects at the start and at the end of the frame of coefficients to be stored in memory. It is possible to get around this problem by using bi-orthogonal wavelets, which then necessitates using filters for reconstruction which are different from those for breakdown, but their response being symmetric, only the coefficients of a single side are stored.

Figure 7:
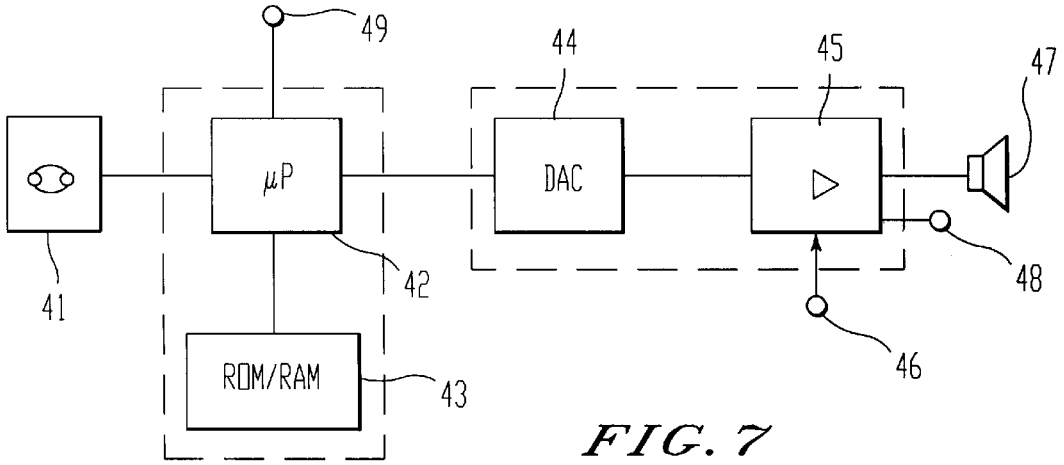
FIG. 7 is a simplified block diagram of a voice synthesis device employing the method of the invention.

At FIG. 7 the simplified diagram of a voice synthesis device has been represented, implementing the method in accordance with the invention. The coefficients of the reconstruction filters are stored in a memory 41 and used by a specialized computer or a microprocessor 42 which reconstructs the voice signal under the control of the reconstruction algorithm described above and stored in its program memory 43 with the values of the impulse responses of the various reconstruction filters. The digital values of the reconstructed signal are converted into analog by the converter 44 which is followed by an amplifier 45 with a low-pass analog filter (with a cut off frequency of 4 kHz for example) and gain control 46. The output of the amplifier 45 is linked to a loudspeaker 47. The amplifier advantageously comprises a high-impedance output 48 which may be linked to an appropriate recording device. The microprocessor 42 is moreover linked to one input 49 (for example serial RS232 or RS422 input) through which it receives requests for synthesis of voice messages. These requests may originate from alarm circuits.

Figure 9:
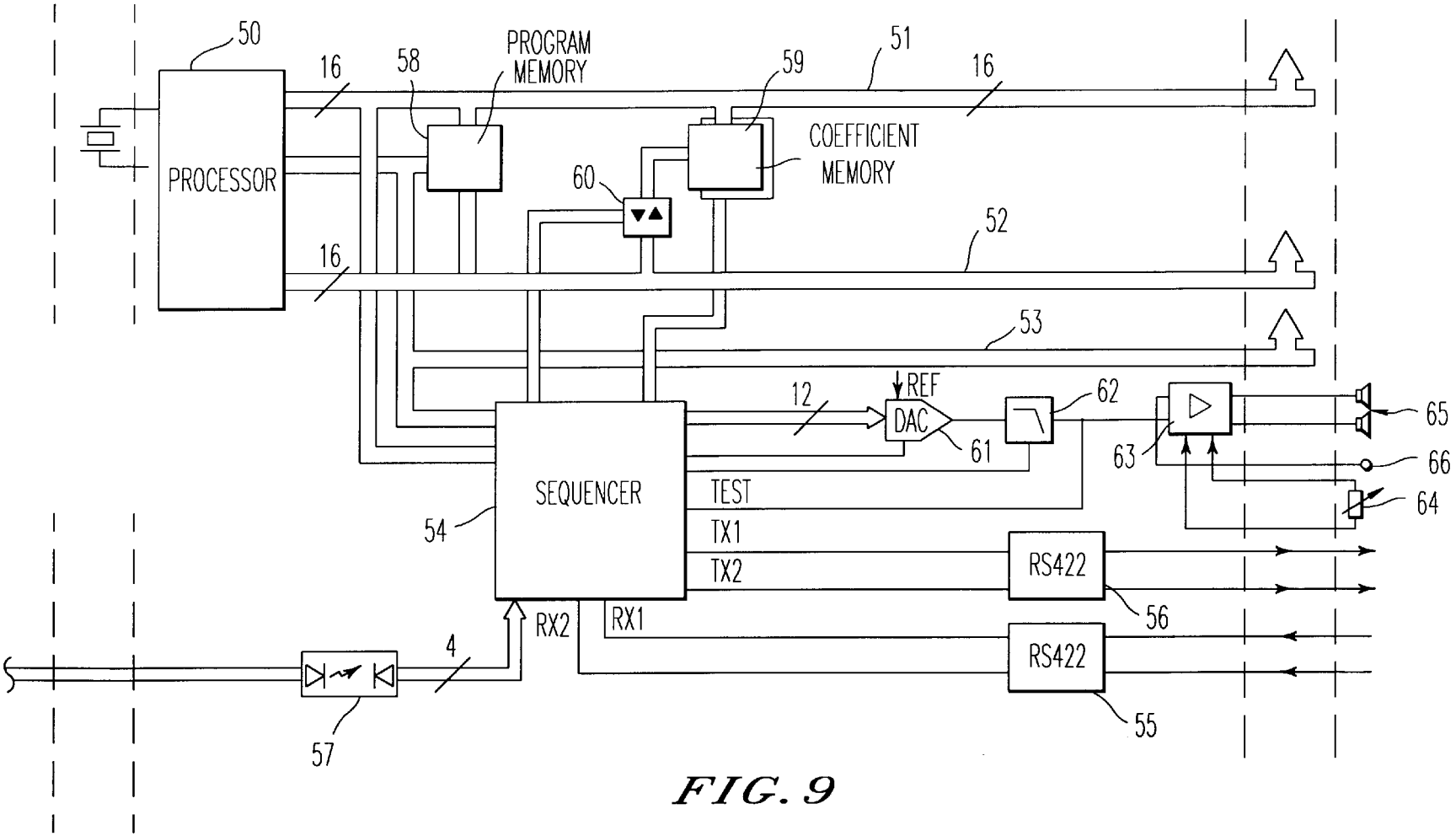
FIG. 9 is a diagram of a synthesis device employing the method in accordance with the invention.

On the detailed diagram of the voice synthesis device of FIG. 9, the processor 50 has been represented with its address bus 51, its data bus 52 and its control bus 53, which is linked in particular to a logic sequencer 54. The sequencer is linked to a serial input interface 55 and to a serial output interface 56, and via an opto-isolation circuit 57 to a device for control of synthesis of messages (which is not represented), which sends it the addresses of the messages to be synthesized. A program memory 58 is linked to the three buses 51 to 53. The coefficients are stored in a memory 59 linked directly to the address bus and to the sequencer 54 and linked via a three-state gate 60 to the data bus, the gate 60 being controlled by the sequencer 54.

The buses 51 to 53 may be linked to an external connector for remotely loading coefficients or modifying the reconstruction program, in order to carry out tests or maintenance tasks.

The sequencer 54 is linked to a digital/analog converter 61 followed by a low-pass filter 62 and by a low-frequency amplifier 63 whose gain may be adjusted by a potentiometer 64. The amplifier 63 is linked to one or more loudspeakers 65 and to a high-impedance output terminal 66.

The processing of the edge effects is made indispensable where a significant level of breakdown is used. It may be achieved by artificially making the speech frames odd, by adding, on one side of one speech frame or on both sides, a copy of a part of this frame; for example, for a frame of 256 points, 128 points are added on one side or on both.

It is possible to adopt an autoregressive modelling of the frame (25.6 ms) of voiced speech in order to artificially extend its duration via a time extrapolation.

The synthesis processing which is described above by blocks may be implemented by N separate filters in cascade (vocoder type). This method limits the edge effects due to refreshing of the filtering values, but penalized the processor since then the optimizations described during the dyadic breakdown are not used.

The orthogonal basis chosen is with compact support, which optimizes the calculation time of the convolution of the filtering. The coefficients are real, which allows an easy interpretation of the modulus and of the sign, and which relaxes the constraints related to the physical exploitation of the modulo 2 π (when the basis is complex). When the number of points used is less than about 30, a time convolution is carried out. It is possible to use several orthogonal bases, with different regularities.

- the breakdown is not established at a given level, but each filter is adapted in width (for example oblique breakdown level: analysis at constant $$Q\left\{\frac{\Delta f}{f}\right\})$$

by virtue of the level which is variable as a function of the optimization linked to the speech. It is possible, for example, to perform a finer cutout around 800 Hz;

- the choice of the regularity of the synthesis wavelet may, for example, be determined by a preliminary analysis of the speech frames (by "voicing wavelet" which is, for example, a mean wavelet determined on the basis of the three classes of voicing or the third derivative of a gaussian);
  - voiced frame (harmonic structure): regularity 6 to 10, approximately;
  - non-voiced frame (plosives, fricatives): low regularity (1 to 6);
- the rearranging of the wavelet coefficients (result of the scalar product) as a function of their frequency position makes it possible to more easily process the time scale analysis and to see it as a time-frequency analysis;
- a vector quantization makes it possible to optimize the throughput by adapting the coding as a function of the frequency rank and of the energy to be coded. Whatever the method employed (for example dichotomy), the outcome always remains the production of a multi-resolution "codebook" (a "codebook" being a set of vectors which comprise all the "classes" or vectors characterizing the center of gravity of clouds of points). In the final analysis, the attempt is made to choose minimal distortion (low quadratic error) which is as small a penalty as possible;

- the number of coding bits of a vector of the codebook is a function of the energy processed (high number for the fundamental, low for the extreme frequencies).

I claim:

1. A method for voice synthesis comprising the steps of:

digitizing an input analog voice signal by an analog to digital conversion to generate a digitized signal;

breaking up the digitized signal into at least one orthogonal basis of wavelets, each wavelet having first and second components, with compact support, by use of breakdown filters with predetermined coefficients, the predetermined coefficients being real coefficients;

selecting from all of the predetermined coefficients only a selected portion of the predetermined coefficients which provide a restored analog signal of an adjudged satisfactory quality;

storing only the selected portion of the predetermined coefficients; and reconstructing the input analog voice signal from the digitized signal by a reconstruction filtering utilizing the stored coefficients;

wherein the step of reconstructing the input analog voice signal comprises the substeps of:

interpolating and filtering the first components of the wavelets;

interpolating and filtering the second components of the wavelets;

adding the interpolated and filtered first and second components of the wavelets to generate a resulting signal;

multiplying the resulting signal; and low-frequency amplifying the multiplied resulting signal.

2. The method according to claim 1, wherein the digitized signal includes speech frames and wherein a regularity of the wavelets is determined by a preliminary analysis of the speech frames of the digitized signal.

3. The method according to claim 2, wherein the regularity of the wavelets is about 6 to 10.

4. The method according to claim 2, wherein the regularity of the wavelets is from 1 to 6.

5. The method according to claim 2, wherein in order to process edge effects, the speech frames are made artificially odd.

6. The method according to claim 2, wherein for a regularity greater than 16, the filtering is done by multiplication in a dual frequency space.

7. The method according to claim 1, wherein the wavelets are Daubechies wavelets.

8. The method according to claim 1, wherein the wavelets are bi-orthogonal wavelets.

9. The method according to claim 1, wherein the filtering is done by convolution.

* * * * *